US009118125B2

(12) United States Patent
Saitou

(10) Patent No.: US 9,118,125 B2
(45) Date of Patent: Aug. 25, 2015

(54) EARTH TERMINAL MOUNTED TOOL

(71) Applicant: YAZAKI CORPORATION, Minato-ku, Tokyo (JP)

(72) Inventor: Hideaki Saitou, Kosai (JP)

(73) Assignee: YAZAKI CORPORATION, Tokyo (JP)

( * ) Notice: Subject to any disclaimer, the term of this patent is extended or adjusted under 35 U.S.C. 154(b) by 17 days.

(21) Appl. No.: 14/223,191

(22) Filed: Mar. 24, 2014

(65) Prior Publication Data

US 2014/0206223 A1 Jul. 24, 2014

Related U.S. Application Data

(63) Continuation of application No. PCT/JP2012/006158, filed on Sep. 26, 2012.

(30) Foreign Application Priority Data

Sep. 27, 2011 (JP) ..... 2011-210853

(51) Int. Cl.

| | |
|---|---|
| ***H01R 4/36*** | (2006.01) |
| ***H01R 11/01*** | (2006.01) |
| ***H01R 4/64*** | (2006.01) |
| ***H01R 11/09*** | (2006.01) |

(Continued)

(52) U.S. Cl.

CPC ..... *H01R 11/01* (2013.01); *H01R 4/64* (2013.01); *H01R 11/09* (2013.01); *H01R 4/34* (2013.01); *H01R 11/12* (2013.01)

(58) Field of Classification Search

CPC ..... H01R 4/36; H01R 11/09; H01R 4/363; H01R 4/643; H01R 4/60

See application file for complete search history.

(56) References Cited

U.S. PATENT DOCUMENTS 2,021,399 A * 11/1935 Becker, Sr. et al. ..... 439/798
3,243,764 A * 3/1966 McGrane et al. ..... 439/798
3,414,868 A * 12/1968 Howe ..... 439/521

(Continued)

FOREIGN PATENT DOCUMENTS

JP H1-107878 U 7/1989
JP 2-20280 U 2/1990

(Continued)

OTHER PUBLICATIONS

Communication dated Apr. 22, 2015, issued by the Japanese Patent Office in counterpart Japanese application No. 2011-210853.

(Continued)

*Primary Examiner* — Gary Paumen
(74) *Attorney, Agent, or Firm* — Sughrue Mion, PLLC

(57) ABSTRACT

A thin plate-like earth terminal mounted tool is with: earth wires connected to electric components, earth terminals respectively connected to end portions of the earth wires, and the earth terminals individually connected to the earth terminal mounted tool. The earth terminal mounted tool includes: a body connecting portion connected to a body of a vehicle; and an earth connecting portion connected to the body connecting portion and to which the earth terminals are individually connected. The earth connecting portion includes at least a first earth connecting section to which the earth terminals along a first direction are connected, and a second earth connecting section to which the earth terminals along a second direction intersecting with the first direction are connected.

6 Claims, 6 Drawing Sheets

(51) Int. Cl.
*H01R 11/12* (2006.01)
*H01R 4/34* (2006.01)

(56) References Cited

U.S. PATENT DOCUMENTS

| | | | | |
|---|---|---|---|---|
| 5,266,057 | A * | 11/1993 | Angel et al. | 439/724 |
| 6,036,554 | A | 3/2000 | Koeda et al. | |
| 6,837,754 | B1 * | 1/2005 | Walton | 439/798 |
| 7,458,861 | B1 * | 12/2008 | Eke et al. | 439/798 |
| 8,647,159 | B2 * | 2/2014 | Steeves | 439/798 |
| 2003/0199207 | A1 * | 10/2003 | Abdo | 439/797 |

FOREIGN PATENT DOCUMENTS

| | | | |
|---|---|---|---|
| JP | 10-208790 | A | 8/1998 |
| JP | 11-54166 | A | 2/1999 |
| JP | 4316430 | B2 | 8/2009 |
| JP | 2011-49106 | A | 3/2011 |

OTHER PUBLICATIONS

Communication dated Jul. 7, 2015, issued by the Japan Patent Office in corresponding Japanese Application No. 2011-210853.

* cited by examiner

EARTH TERMINAL MOUNTED TOOL

CROSS REFERENCE TO RELATED APPLICATIONS

This application is a continuation of International Application No. PCT/JP2012/006158, filed Sep. 26, 2012, and based upon and claims the benefit of priority from Japanese Patent Application No. 2011-210853, filed Sep. 27, 2011, the entire contents of all of which are incorporated herein by reference.

TECHNICAL FIELD

The present invention relates to an earth terminal mounted tool to which a plurality of earth terminals are individually connected.

BACKGROUND ART

Conventionally, of electric components installed on a vehicle such as an automobile, a joint connector and a wire bonding are known which earth, to a body of the vehicle, a wire which is a combination of a plurality of earth wires connected respectively to a plurality of electric components in need of an earth connection (refer to JP 10-208790 A and JP 11-054166 A (Patent Family: U.S. Pat. No. 6,036,554 A, EP 0895306 A1)).

In the above conventional joint connector and wire bonding, when a current flows simultaneously through some of wires in the earth wires, as the case may be, the electric components become unstable or unfunctionable due to a potential change attributable to a voltage drop.

For preventing the electric components from becoming unstable or unfunctionable due to the potential change, it is desirable to individually earth each of the earth wires to the body of the vehicle. Thus, there is known an earth terminal mounted tool made of a linear plate having such a structure that earth terminals each mounted to an end portion of one of earth wires can be tightened with individual bolts (refer to JP 2-020280 U). In this conventional earth terminal mounted tool, a plurality of earth terminals can be earthed to the body of the vehicle by minimizing number of openings for connecting the earth terminals in the body of the vehicle.

SUMMARY OF INVENTION

Since the conventional earth terminal mounted tool described above is formed with the linear plate, the earth terminals can be mounted to the earth terminal mounted tool from the same direction. However, when it is attempted to mount the earth terminals to the conventional earth terminal mounted tool from directions different from each other, some of the earth terminals may intersect with adjacent earth terminal. Thus, it was difficult to mount the earth terminals to the conventional earth terminal mounted tool from directions different from each other.

It is, therefore, an object of the present invention to provide an earth terminal mounted tool to which a plurality of earth terminals can be reliably mounted even when the earth terminals are mounted to the earth terminal mounted tool from directions different from each other.

For solving the above problem, according to a first aspect of the present invention, there is provided a thin plate-like earth terminal mounted tool with: a plurality of earth wires respectively connected to a plurality of electric components installed on a vehicle, a plurality of earth terminals respectively connected to end portions of the earth wires and the earth terminals individually connected to the earth terminal mounted tool. The earth terminal mounted tool includes a body connecting portion connected to a body of the vehicle, and an earth connecting portion connected to the body connecting portion and to which the earth terminals are individually connected. The earth connecting portion includes at least a first earth connecting section to which the earth terminals along a first direction are connected, and a second earth connecting section to which the earth terminals along a second direction intersecting with the first direction are connected.

That is, the first earth connecting section and the second earth connecting section are connected to the earth terminals from directions different from each other. This can prevent each of the earth terminals from intersecting with adjacent earth terminals 30. Thus, even when the earth terminals are to be mounted to the earth terminal mounted tool from directions different from each other, the earth terminals can be reliably mounted to the earth terminal mounted tool.

Further, compared with the conventional example in which the joint connector or wire bonding is used, especially, in the case of a large current flow, the potential change can be reliably prevented by using the earth terminal mounted tool. Further, since the earth terminals can be individually earthed to the body of the vehicle by way of the earth terminal mounted tool, the noise (especially, high-frequency interference) attributable to the voltage drop which may be caused when using the joint connector or wire bonding according to the conventional example can be suppressed. Thus, it is possible to reliably prevent the electric component from becoming unstable or unfunctionable by using the earth terminal mounted tool.

It is preferable that: each of the earth terminals includes a bent portion formed by bending a distal end of each of the earth terminals; the first earth connecting section is formed with a first locking portion with which the bent portion can be locked; and the second earth connecting section is formed with a second locking portion with which the bent portion can be locked.

Thus, locking the bent portion of the earth terminal with the first locking portion or the second locking portion can position each of the earth terminals. Therefore, movement of each of the earth terminals can be suppressed when each of the earth terminals is to be fixed to the earth terminal mounted tool. Further, since the directions of the earth terminals can be oriented, as a matter of course, the intersecting of each of the earth terminals with adjacent earth terminals can be prevented, and also intersecting of each of the earth wires with adjacent earth wires can be suppressed.

It is preferable that the first locking portion includes first cutout grooves formed along the first direction and that the second locking portion includes second cutout grooves formed along the second direction.

The earth connecting portion may further include a third earth connecting section to which the earth terminals along a third direction are connected.

The first aspect of the present invention can provide the earth terminal mounted tool to which each of the earth terminals can be reliably mounted even when the earth terminals are mounted to the earth terminal mounted tool from directions different from each other.

DESCRIPTION OF EMBODIMENTS

Figure 1:
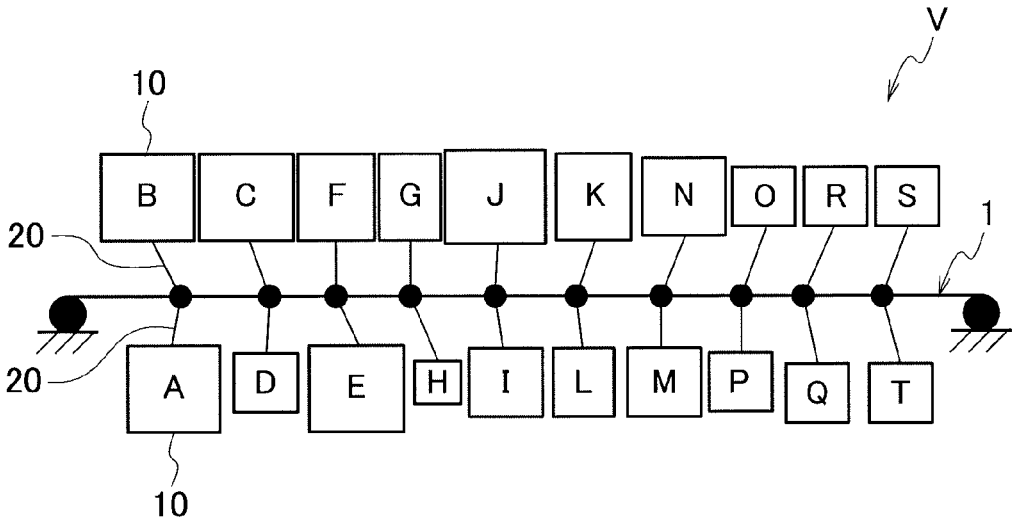
FIG. 1 is a structural diagram illustrating electric components and the like to be installed on a vehicle, according to a first embodiment.

Referring to the drawings, an explanation will be made about an earth terminal mounted tool according to embodiments of the present invention.

In the description of the following drawings, the same or similar reference numerals or signs are added to the same or similar portions. Note that the drawings are schematic and, therefore, ratios and the like of each dimension are different from those of actual ones.

Thus, specific dimensions and the like should be determined referring to the following explanations. Further, different mutual dimensional relations or different mutual dimensional ratios between the drawings may be included.

(1) First Embodiment

Figure 2:
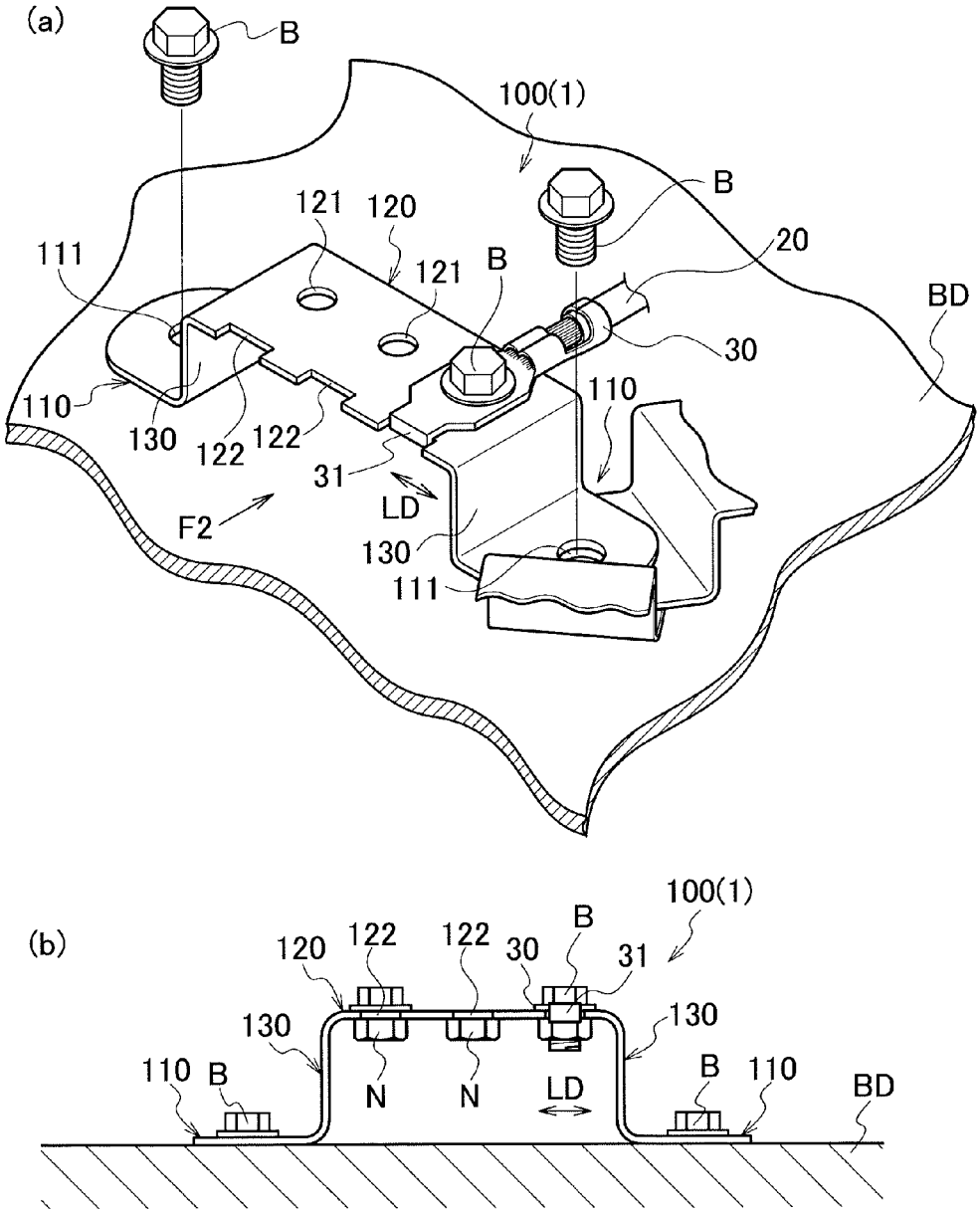
FIG. 2(*a*) is a perspective view illustrating a part of an earth terminal mounted tool according to the first embodiment and FIG. 2(*b*) is a side view illustrating a part of the earth terminal mounted tool according to the first embodiment (viewed in a direction indicated by an arrow F2 in FIG. 2(*a*)).
Figure 3:
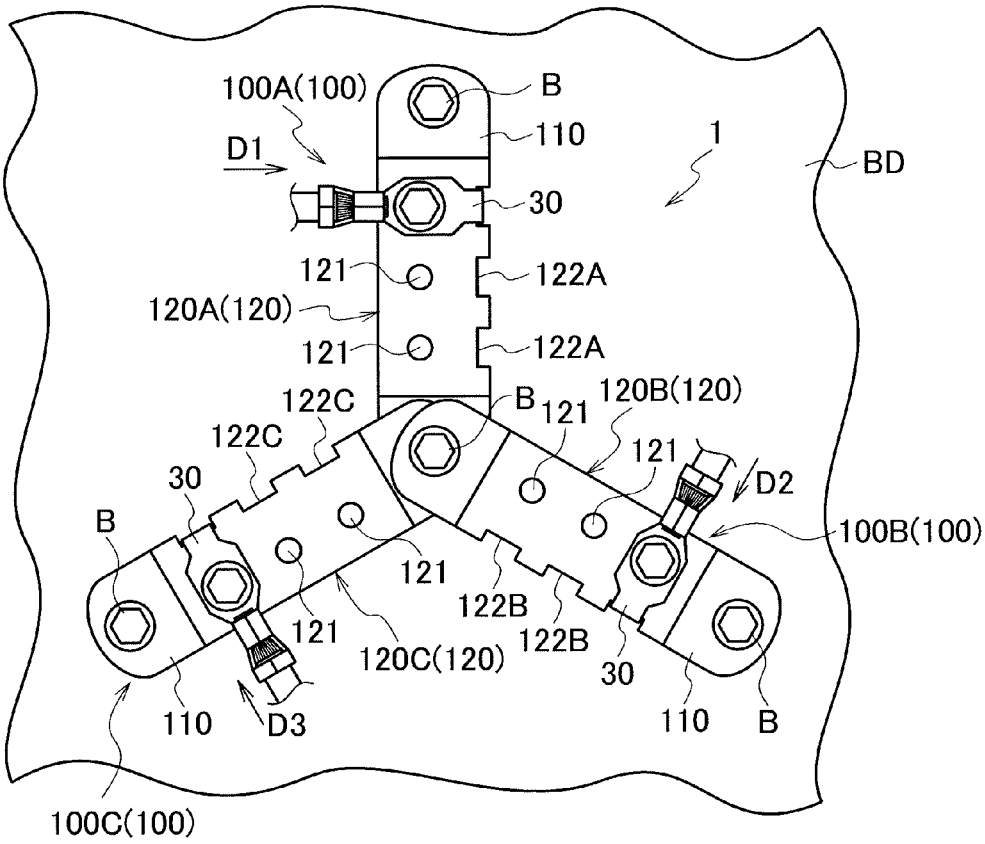
FIG. 3 is a plan view illustrating the earth terminal mounted tool according to the first embodiment.

Referring to FIGS. 1 to 3, an explanation will be made about an earth terminal mounted tool according to a first embodiment.

(1.1) Schematic Structure of Vehicle

An explanation will be made about the schematic structure of a vehicle V which uses an earth terminal mounted tool 1 according to the first embodiment. Herein, the vehicle V is an automobile (including a hybrid vehicle, an electric vehicle, and the like).

As illustrated in FIG. 1, a plurality of electric components 10 (A to T) are installed on the vehicle V. An earth wire 20 made of a core wire and a covering material is connected to each of the electric components 10 (A to T). An earth terminal 30 is mounted to an end portion of each earth wire 20.

Each earth terminal 30 is connected to the earth terminal mounted tool 1 by tightening of a bolt B (for example, a hexagonal bolt with washer) and a nut N and is earthed to a body of the vehicle by way of the earth terminal mounted tool 1.

(1.2) Structure of Earth Terminal Mounted Tool

An explanation will be made about the structure of the earth terminal mounted tool 1 according to the first embodiment.

As illustrated in FIGS. 2(*a*) and 2(*b*), the earth terminal mounted tool 1 is formed by bending a thin conductive plate.

As illustrated in FIG. 3, the earth terminal mounted tool 1 includes three mounted members 100A, 100B, 100C extending along different directions. Having the same structure, hereinafter the mounted members 100A, 100B, 100C are each simply referred to as a mounted member 100.

As illustrated in FIGS. 2(*a*) and 2(*b*), the mounted member 100 includes a pair of body connecting portions 110 connected to the body BD of the vehicle V and an earth connecting portion 120 connected with the body connecting portions 110 and to which a plurality of earth terminals 30 can be individually connected.

Each of the body connecting portions 110 is provided along the body BD in such a manner as to abut the body BD. Each of the vehicular body connecting portions 110 is formed with a circular bolt inserting hole 111 through which the bolt B passes.

By way of rising portions 130 connected with the body connecting portions 110 and rising at about 90 degrees, the earth connecting portion 120 is provided in a position further away from the body BD than the body connecting portions 110. The earth connecting portion 120 is formed with a plurality (three in the drawings) of circular holes 121 which are arranged along a longitudinal direction LD and through each of which the bolt B passes. The earth connecting portion 120 is formed with a plurality (three in the drawings) of locking portions 122 each capable of locking a bent portion 31 which is formed by bending a distal end portion of the earth terminal 30.

As illustrated in FIG. 2(*b*), the nuts N with each of which the bolts B are screwed are fixed by welding to a rear face (body BD side) of the earth connecting portion 120. Then, each of the earth terminals 30 is conductively connected with the earth terminal mounted tool 1 (earth connecting portion 120) by tightening of the bolt B with the nut N.

As set forth above, the earth terminal mounted tool 1 has three mounted members 100 each including the body connecting portions 110 and the earth connecting portion 120 and extending along different directions. That is, as illustrated in FIG. 3, the earth connecting portion 120 includes a first earth connecting section 120A, a second earth connecting section 120B, and a third earth connecting section 120C.

The earth terminals 30 each extending along a first direction Dl are connected with the first earth connecting section 120A. The first earth connecting section 120A is formed with first locking portions 122A with each of which the bent portion 31 of the earth terminal 30 is locked. Each of the first locking portions 122A is rectangular and includes a first cutout groove formed along the first direction D1.

The earth terminals 30 each extending along a second direction D2 intersecting with the first direction D1 are connected with the second earth connecting section 120B. The second earth connecting section 120B is formed with second locking portions 122B with each of which the bent portion 31 of the earth terminal 30 is locked. Each of the second locking portions 122B is rectangular and includes a second cutout groove formed along the second direction D2.

The earth terminals 30 each extending along a third direction D3 intersecting with the first direction D1 and second direction D2 are connected with the third earth connecting section 120C. The third earth connecting section 120C is foamed with third locking portions 122C with each of which the bent portion 31 of the earth terminal 30 is locked. Each of the third locking portions 122C is rectangular and includes a third cutout groove formed along the third direction D3.

As set forth above, according to the first embodiment, in plan view, the first earth connecting section 120A, the second earth connecting section 120B, and the third earth connecting section 120C are provided at an interval of about 120 degrees, respectively. That is, the earth terminal mounted tool 1 is formed into a substantially Y-shaped configuration in plan view.

(1.3) Operations and Effects

As set forth above, the earth terminal mounted tool 1 according to the first embodiment includes at least the first earth connecting section 120A with which the earth terminals 30 extending along the first direction D1 are connected and the second earth connecting section 120B with which the earth terminals 30 extending along the second direction D2 are connected as the earth connecting portion 120. That is, the first earth connecting section 120A and the second earth connecting section 120B are each connected with the earth terminals 30 from directions different from each other, thus making it possible to prevent the earth terminals 30 from intersecting with adjacent earth terminals 30. Thus, even when the earth terminals 30 are to be mounted to the earth terminal mounted tool 1 from directions different from each other, the earth terminals 30 can be reliably mounted to the earth terminal mounted tool 1.

Further, compared with the conventional example using the joint connector or wire bonding, especially in the case of a large current flow, the potential change can be reliably prevented by using the earth terminal mounted tool 1 according to the first embodiment. Further, since the earth terminals 30 can be individually earthed to the body of the vehicle by way of the earth terminal mounted tool 1, the noise (especially, high-frequency interference) attributable to the voltage drop which may be caused when using the joint connector or wire bonding according to the conventional example can be suppressed. Thus, it is possible to reliably prevent the electric components from becoming unstable or unfunctionable.

With the earth terminal mounted tool 1 according to the first embodiment, the first earth connecting section 120A is formed with the first locking portions 122A and the second earth connecting section 120B is formed with the second locking portions 122B. Thus, locking the bent portion 31 of each of the earth terminal 30 with each of the first locking portions 122A or second locking portions 122B can position each of the earth terminals 30. Thus, movement of each of the earth terminals 30 can be suppressed when each of the earth terminals 30 is to be fixed to the earth terminal mounted tool 1. Further, since the directions of the earth terminals 30 can be oriented, as a matter of course, the intersecting of each of the earth terminals 30 with adjacent earth terminals 30 can be prevented, and also intersecting of each of the earth wires 20 with adjacent earth wires 20 can be suppressed.

(1.4) Modification

Figure 4:
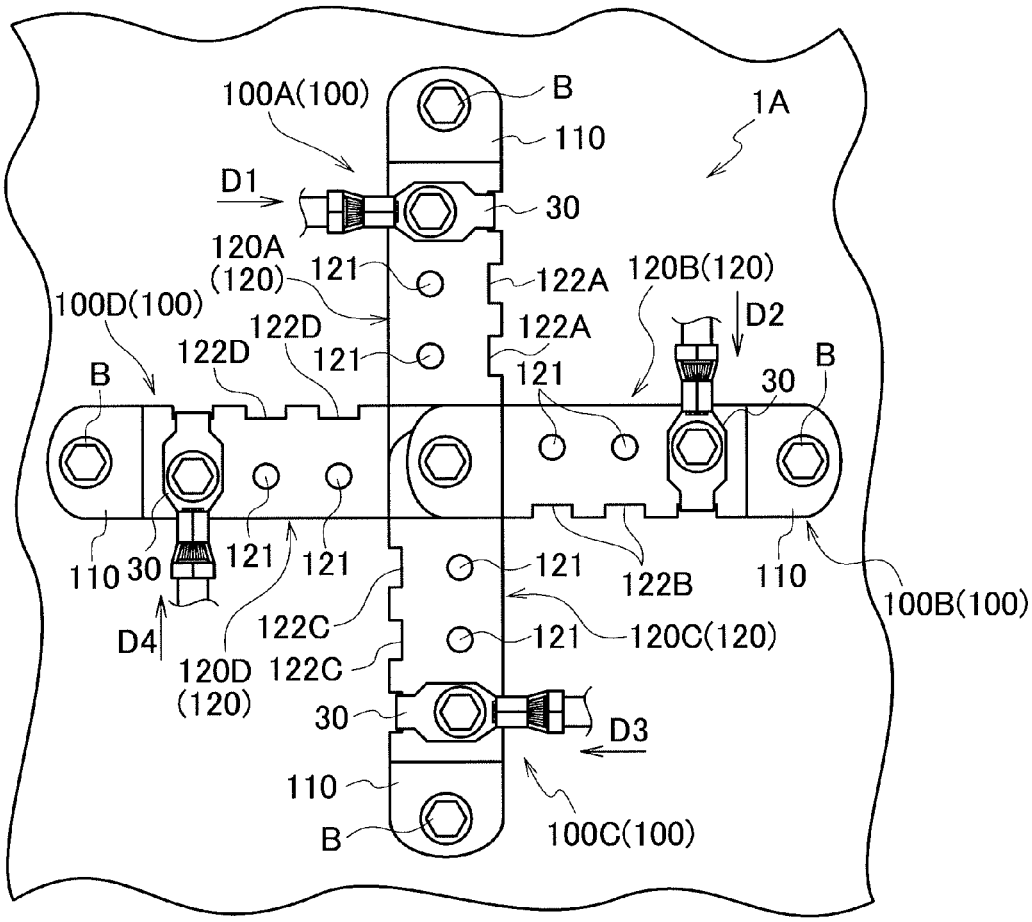
FIG. 4 is a plan view illustrating an earth terminal mounted tool according to a modification of the first embodiment.

Referring to FIG. 4, an explanation will be made about the earth terminal mounted tool 1 according to a modification of the first embodiment. Herein, the same reference numerals or signs are added to the same portions as those of the earth terminal mounted tool 1 according to the first embodiment, and the explanation will be mainly made about different portions.

The earth terminal mounted tool 1 according to the first embodiment includes three mounted members 100A, 100B, and 100C. On the other hand, an earth terminal mounted tool 1A according to the modification includes four mounted members 100A, 100B, 100C, and 100D.

Specifically, the earth terminal mounted tool 1A according to the modification includes the fourth earth connecting section 120D in addition to the first earth connecting section 120A, second earth connecting section 120B, and third earth connecting section 120C which are explained according to the first embodiment.

The terminals 30 each extending along a fourth direction D4 are connected with the fourth earth connecting section 120D. The fourth earth connecting section 120D is formed with fourth locking portions 122D with each of which the bent portion 31 of the earth terminal 30 is locked. Each of the fourth locking portions 122D is rectangular and includes a fourth cutout groove formed along the fourth direction D4.

With the earth terminal mounted tool 1A according to the modification, in plan view, the first earth connecting section 120A and the third earth connecting section 120C are provided linearly, and the second earth connecting section 120B and the fourth earth connecting section 120D are provided linearly. That is, the earth terminal mounted tool 1A is formed into a cross in plan view.

Like the operations and effects of the earth terminal mounted tool 1 according to the first embodiment, the earth terminal mounted tool 1A according to the modification accomplishes that, even when the earth terminals 30 are to be mounted to the earth terminal mounted tool 1A from directions different from each other, the earth terminals 30 can be reliably mounted to the earth terminal mounted tool 1A.

(2) Second Embodiment

Figure 5:
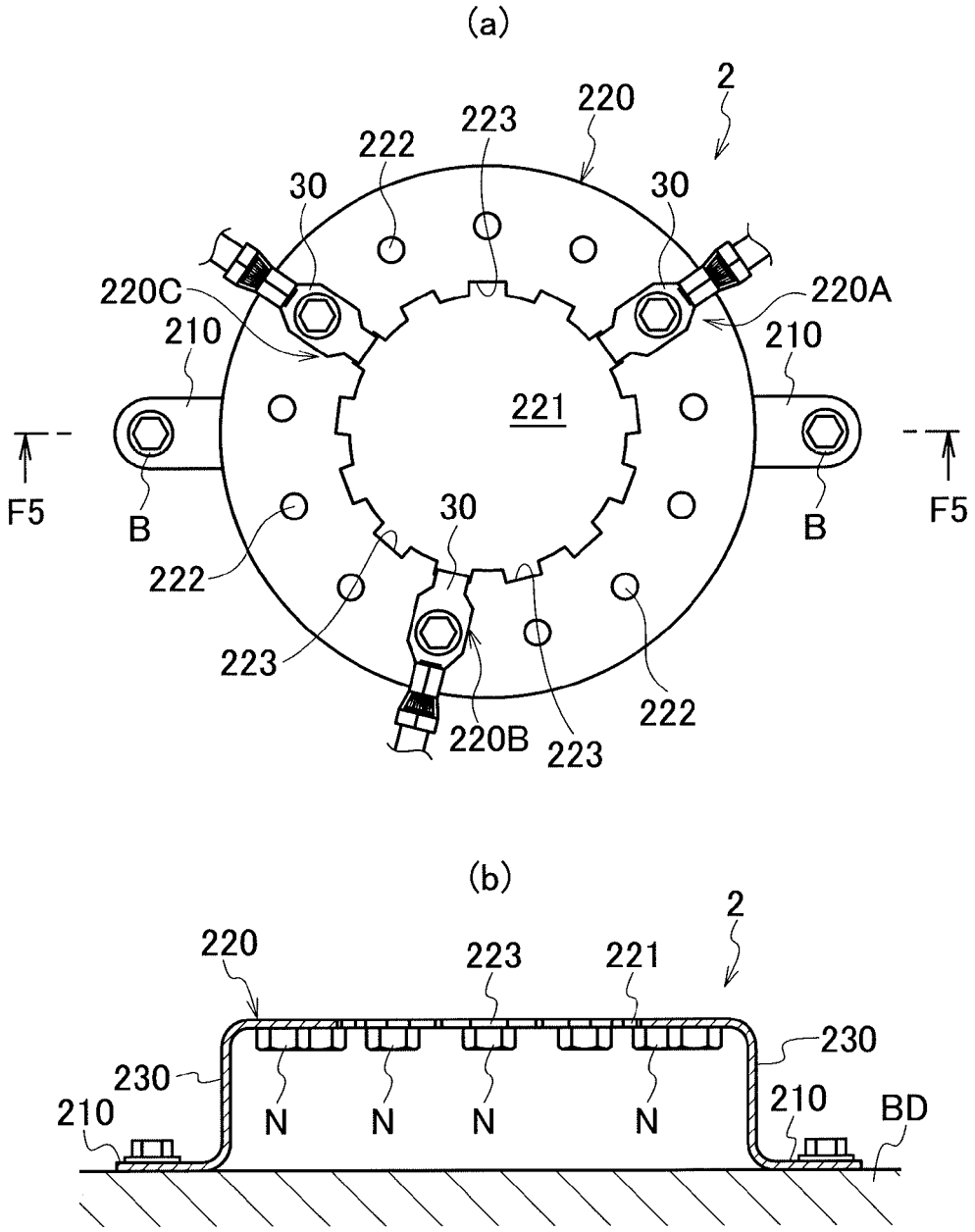
FIG. 5(*a*) is a plan view illustrating an earth terminal mounted tool according to a second embodiment and FIG. 5(*b*) is a cross sectional view taken along the line F5-F5 in FIG. 5(*a*).

Referring to FIG. 5, an explanation will be made about an earth terminal mounted tool 2 according to a second embodiment. Herein, the same reference numerals or signs are added to the same portions as those of the earth terminal mounted tool 1 according to the first embodiment, and the explanation will be mainly made about different portions.

(2.1) Structure of Earth Terminal Mounted Tool

An explanation will be made about the structure of the earth terminal mounted tool 2 according to the second embodiment.

The earth terminal mounted tool 2 includes a pair of body connecting portions 210 connected to the body BD of the vehicle V and an earth connecting portion 220 which is connected with the body connecting portions 210 and with which the earth terminals 30 are individually connected. Since the body connecting portions 210 have the same structure as that of the body connecting portions 110 according to the first embodiment, an explanation thereof will be omitted herein.

The earth connecting portion 220 is, in plan view, provided substantially in a circular form. A center portion of the earth connecting portion 220 is formed with a circular opening 221 along an outer profile. By way of rising portions 230 connected with the body connecting portions 210 and rising at about 90 degrees, the earth connecting portion 220 is provided in a position further away from the body BD than the body connecting portions 210.

In the earth connecting portion 220, a plurality (thirteen in the drawing) of circular bolt inserting holes 222 through each of which the bolt B passes are formed along a circumferential direction. A plurality (thirteen in the drawing) of locking portions 223 with each of which the bent portion 31 of the earth terminal 30 is locked are formed at a circumferential edge of the opening 221 of the earth connecting portion 220. Each of the locking portions 223 includes a cutout groove formed along a direction perpendicular to an outer profile of the earth connecting portion 220.

Like the earth terminal mounted tool 1 according to the first embodiment, it is configured such that the earth terminals 30 extending along directions different from each other are individually connected to the earth terminal mounted tool 2 according to the second embodiment. That is, the earth connecting portion 220 includes a plurality of earth connecting sections 220A, 220B, 220C, and so on.

(2.2) Operations and Effects

Like the operations and effects of the earth terminal mounted tool 1 according to the first embodiment, the earth terminal mounted tool 2 according to the second embodiment accomplishes that, even when the earth terminals 30 are to be mounted to the earth terminal mounted tool 2 from directions different from each other, the earth terminals 30 can be reliably mounted to the earth terminal mounted tool 2.

(2.3) Modifications

Figure 6:
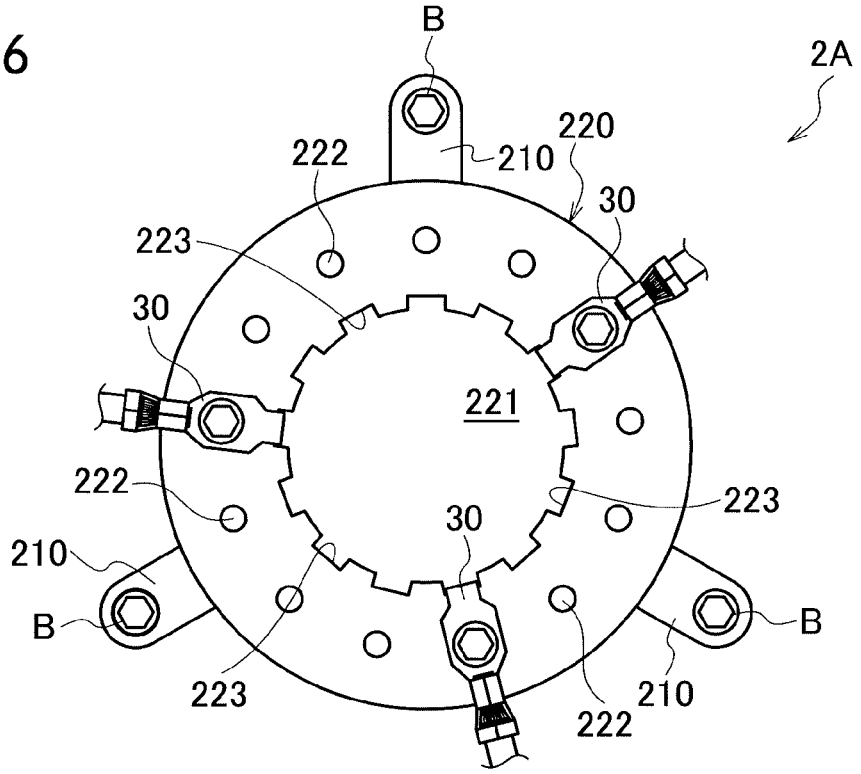
FIG. 6 is a plan view illustrating an earth terminal mounted tool according to a first modification of the second embodiment.
Figure 7:
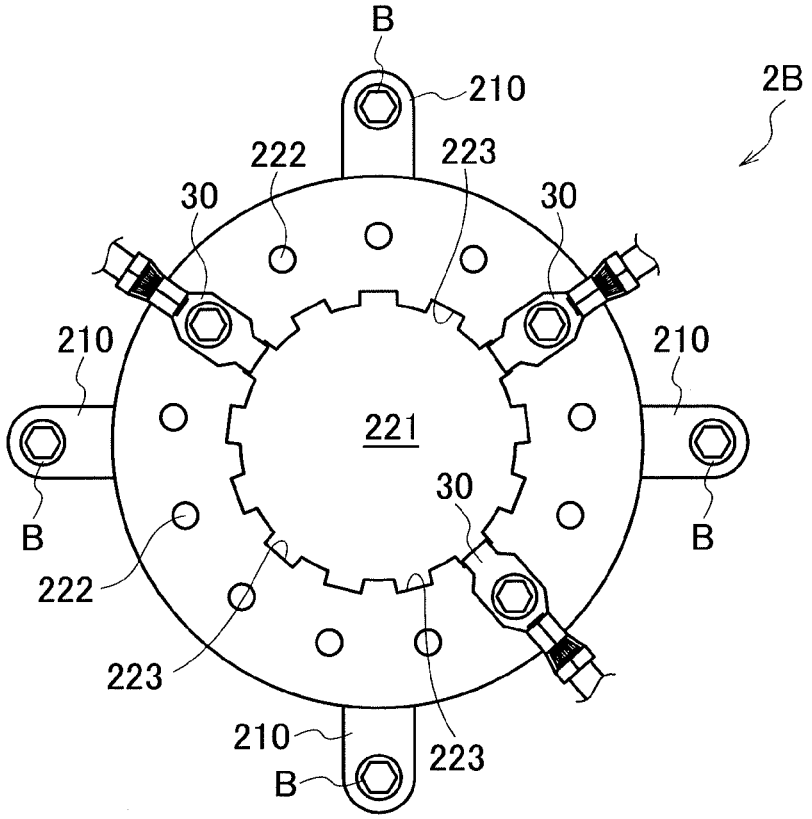
FIG. 7 is a plan view illustrating an earth terminal mounted tool according to a second modification of the second embodiment.

Referring to FIGS. 6 and 7, an explanation will be made about modifications of the earth terminal mounted tool 2 according to the second embodiment. Herein, the same reference numerals or signs are added to the same portions as those of the earth terminal mounted tool 2 according to the second embodiment, and the explanation will be mainly made about different portions.

The earth terminal mounted tool 2 according to the second embodiment includes the pair (i.e., two) of the body connecting portions 210. On the other hand, an earth terminal mounted tool 2A according to a first modification includes, as illustrated in FIG. 6, three of the body connecting portions 210 provided at equal intervals in the circumferential direction.

Herein, it is not necessary to be included three of the body connecting portions 210 at equal intervals in the circumferential direction. For example, an earth terminal mounted tool 2B according to a second modification includes, as illustrated in FIG. 7, four of the body connecting portions 210 provided at equal intervals in the circumferential direction.

Like the operations and effects of the earth terminal mounted tool 1 according to the first embodiment, each of the earth terminal mounted tools 2A and 2B according to the modifications of the second embodiment accomplishes that, even when the earth terminals 30 are to be mounted to the earth terminal mounted tool from directions different from each other, the earth terminals 30 can be reliably mounted to the earth terminal mounted tool.

Further, each of the earth terminal mounted tools 2A and 2B according to the modifications of the second embodiment includes three or four of the body connecting portions 210 at equal intervals in the circumferential direction. Thus, the earth connecting portion 220 can be stably provided in a position away from the body BD and each of the earth terminal mounted tools 2A and 2B can be stably mounted to the body BD. Thus, a contact between the earth connecting portion 220 and the body BD can be prevented.

(3) Other Embodiments

As set froth above, although contents of the present invention have been disclosed through the embodiments of the present invention, it should not be interpreted that the statements or drawings constituting a part of the disclosure limit the present invention. From this disclosure, various alternative embodiments, examples and operational technologies will become obvious to a person skilled in the art.

For example, the embodiments of the present invention can be changed in the following manner. Specifically, in the first embodiment, it was explained that, as a measure of mounting each of the earth terminals 30 to the earth terminal mounted tool 1, the bolt B is tightened to the nut N which is welded and fixed to the rear face of the earth connecting portion 120. However, not limited to this, any measure is acceptable provided that such measure has a structure in which each of the earth terminals 30 can be conductively connected with the earth terminal mounted tool 1 (for example, stud bolt).

Further, in the first embodiment, it was explained that the earth terminal mounted tool 1 has the mounted members 100A, 100*b* and 100C which are separated members from each other. However, not limited to this, the mounted members may be an integrated member.

Further, according to the first embodiment, it was explained that the earth terminal mounted tool 1 is formed into the Y-shaped configuration or the cross in plan view. However, not limited to this, any number of the mounted members 100 may be disposed in various directions.

Further, according to the first embodiment, it was explained that each of the locking portions 122 (i.e., the first locking portions 122A, second locking portions 122B, third locking portions 122C, and fourth locking portions 122D) includes the cutout groove. However, not limited to this, each of the locking portions 122 may have any configuration, dimension and the like provided that each of the locking portions 122 has such a structure (for example, a protrusion) that the bent portion 31 of each of the earth terminals 30 can be locked with each of the locking portions 122.

Likewise, according to the first embodiment and the second embodiment, it was explained that the earth terminal 30 is provided with the bent portion 31. However, not limited to this, the earth terminal 30 may have any configuration, dimension and the like provided that the earth terminal 30 has such a structure (for example, a hole with which a locking protrusion is locked) that each of the earth terminal 30 can be locked with each of the locking portions 122.

Further, according to the second embodiment, it was explained that two to four of the body connecting portions 210 are provided at equal intervals in the circumferential direction. However, not limited to this, any number of the body connecting portions 210 may be provided.

As set froth above, as a matter of course, the present invention can include various embodiments and the like which are not described herein. Thus, the technical scope of the present invention can be determined only by inventive specific matters according to the claimed scope which is proper from the above explanations.

What is claimed is:

1. A thin plate-like earth terminal mounted tool with: a plurality of earth wires respectively connected to a plurality of electric components installed on a vehicle, a plurality of earth terminals respectively connected to end portions of the earth wires, and the earth terminals individually connected to the earth terminal mounted tool, the earth terminal mounted tool comprising:

an earth connecting portion comprising a first earth connecting section to which earth terminals along a first direction can be connected, one end of the first earth connecting portion provided with a first body connecting portion connected to a body of the vehicle, a second earth connecting section to which earth terminals along a second direction intersecting with the first direction can be connected, one end of the second earth connecting portion provided with a second body connecting portion connected to the body of the vehicle, and a third earth connecting section to which earth terminals along a third direction intersecting with the first and the second direction can be connected, one end of the third earth connecting portion provided with a third body connecting portion connected to the body of the vehicle; and a connection member connecting the first, the second, and the third body connecting portion to the body of the vehicle at a point, wherein the first, the second, and the third earth connecting section are radially arranged around the connection member.

2. The earth terminal mounted tool according to claim 1, wherein each of the earth terminals comprises a bent portion formed by bending a distal end of each of the earth terminals, the first earth connecting section is formed with a first locking portion with which the bent portion can be locked, the second earth connecting section is formed with a second locking portion with which the bent portion can be locked, and the third earth connecting section is formed with a third locking portion with which the bent portion can be locked.

3. The earth terminal mounted tool according to claim 2, wherein the first locking portion includes a plurality of first cutout grooves arranged along the first direction, the second locking portion includes a plurality of second cutout grooves arranged along the second direction, and the third locking portion includes a plurality of third cutout grooves arranged along the third direction.

4. The earth terminal mounted tool according claim 1, wherein the earth connecting portion further comprises a fourth earth connecting section to which earth terminals along a fourth direction intersecting with the first, the second, and the third direction can be connected, one end of the fourth earth connecting portion provided with a fourth body connecting portion connected to the body of the vehicle, the connection member connects the first, the second, the third, and the fourth body connecting portion to the body of the vehicle at a point, and the first, the second, the third, and the fourth earth connecting section are radially arranged around the connection member.

5. A thin plate-like earth terminal mounted tool with: a plurality of earth wires respectively connected to a plurality of electric components installed on a vehicle, a plurality of earth terminals respectively connected to end portions of the earth wires, and the earth terminals individually connected to the earth terminal mounted tool, the earth terminal mounted tool comprising:

two or more body connecting portions one end of each of the body connecting portions connected to a body of the vehicle at a point;

an earth connecting portion provided substantially in a thin plate-like circular form formed with a circular opening along an outer profile, connected to the other end of each of the body connecting portions, and provided in a position further away from the body than the body connecting portions; and a plurality of locking portions formed at a circumferential edge of the opening of the earth connecting portion, each including a cutout groove formed along a direction perpendicular to an outer profile of the earth connecting portion and capable to lock each of the earth terminals respectively.

6. The earth terminal mounted tool according to claim 5, wherein the earth connecting portion includes a plurality of bolt inserting holes through each of which a bolt passes, the bolt inserting holes formed along a circumferential direction of the earth connecting portion and each correspondingly provided with each of the locking portions respectively.

* * * * *